US005347954A

United States Patent [19]

Dietz

[11] Patent Number: 5,347,954

[45] Date of Patent: Sep. 20, 1994

[54] FLUIDIZED BED COMBUSTION SYSTEM HAVING AN IMPROVED PRESSURE SEAL

[75] Inventor: David H. Dietz, Hampton, N.J.

[73] Assignee: Foster Wheeler Energy Corporation, Clinton, N.J.

[21] Appl. No.: 89,982

[22] Filed: Jul. 6, 1993

[51] Int. Cl.[5] ..... F22B 1/00

[52] U.S. Cl. ..... 122/4 D; 165/104.16; 422/145; 110/245

[58] Field of Search ..... 122/4 D; 110/245; 165/104.16; 422/139, 145, 146

[56] References Cited

U.S. PATENT DOCUMENTS 3,880,597 4/1975 Goldschmidt et al. .
4,165,717 8/1979 Reh et al. .
4,276,063 6/1981 Lackey et al. .
4,469,050 9/1984 Korenberg .
4,548,138 10/1985 Korenberg .
4,552,203 11/1985 Chrysostome et al. .
4,665,864 5/1987 Seshamani et al. .
4,682,567 7/1987 Garcia-Mallol et al. .
4,709,662 12/1987 Rawdon .
4,709,663 12/1987 Larson et al. .
4,716,856 1/1988 Beisswenger et al. .
4,761,131 8/1988 Abdulally et al. .
4,813,479 3/1989 Wahlgren .
4,827,723 5/1989 Engstrom et al. .
4,860,694 8/1989 Walker ..... 122/4 D
4,896,717 1/1990 Campbell, Jr. et al. .
4,947,804 8/1990 Abdulally .
4,952,247 8/1990 Schrader et al. .
5,054,436 10/1991 Dietz .
5,069,170 12/1991 Gorzegno et al. .
5,069,171 12/1991 Hansen et al. .
5,140,950 8/1992 Abdulally .

*Primary Examiner*—Edward G. Favors
*Attorney, Agent, or Firm*—Marvin A. Naigur

[57] ABSTRACT

A fluidized bed combustion system in which a separator receives a mixture of flue gases and entrained particulate material from a fluidized bed in a furnace. A pressure seal valve, in the form of two ducts, connects an outlet of the separator to the furnace for recycling the separated particulate material back to the furnace. A pressure head builds up in one of the ducts and air is introduced to the other duct to dampen pressure fluctuations in the furnace and promote the flow of the particulate material back to the furnace.

17 Claims, 2 Drawing Sheets

FLUIDIZED BED COMBUSTION SYSTEM HAVING AN IMPROVED PRESSURE SEAL

This invention relates to a fluidized bed combustion system and method, and, more particularly, to such a system and method in which an improved pressure seal is provided between the furnace section of the fluidized bed and the separating section.

Fluidized bed combustion systems are well known and include a furnace section in which air is passed through a bed of particulate material, including a fossil fuel, such as coal, and a sorbent for the oxides of sulfur generated as a result of combustion of the coal, to fluidize the bed and to promote the combustion of the fuel at a relatively low temperature. These types of combustion systems are often used in steam generators in which water is passed in a heat exchange relationship to the fluidized bed to generate steam and permit high combustion efficiency and fuel flexibility, high sulfur adsorption and low nitrogen oxides emissions.

The most typical fluidized bed utilized in the furnace section of these type systems is commonly referred to as a "bubbling" fluidized bed in which the bed of particulate material has a relatively high density and a well-defined, or discrete, upper surface. Other types of systems utilize a "circulating" fluidized bed in which the fluidized bed density is below that of a typical bubbling fluidized bed, the fluidizing air velocity is equal to or greater than that of a bubbling bed, and the flue gases passing through the bed entrain a substantial amount of the fine particulate solids to the extent that they are substantially saturated therewith.

Circulating fluidized beds are characterized by relatively high internal and external solids recycling which makes them insensitive to fuel heat release patterns, thus minimizing temperature variations and, therefore, stabilizing the sulfur emissions at a low level. The external solids recycling is achieved by disposing a cyclone separator at the furnace section outlet to receive the flue gases, and the solids entrained thereby, from the fluidized bed. The solids are separated from the flue gases in the separator and the flue gases are passed to a heat recovery area while the solids are recycled back to the furnace. This recycling improves the efficiency of the separator, and the resulting increase in the efficient use of sulfur adsorbent and fuel residence time reduces the adsorbent and fuel consumption.

In the circulating fluidized bed arrangements, it is important that a pressure seal be provided between the separator and the furnace section to prevent backflow of gases, with entrained solids, directly from the furnace to the outlet of the separator. Previous arrangements have utilized what is commonly called a "J-valve" which has a vertical dipleg portion extending from the separator and a U-shaped portion extending from the dipleg to create the pressure seal. Applicant's U.S. Pat. No. 5,040,492, assigned to the assignee of the present invention, discloses the use of a J-valve used in this type of environment. J-valves of this type are designed so that the height of the solids in the dipleg portion of the valve directly corresponds to the sum of the pressure drops across the furnace and the separator. However, during shutdown or the like, when the solid materials must be completely removed from the system, it is very difficult, if not impossible, to drain the solids from the vertical portion of the J-valve. Moreover, in order to operate satisfactorily, these J-valves require a relatively high fluidizing air pressure necessitating additional fans which are expensive.

In order to overcome these deficiencies, an "L-valve" has been devised which includes a vertical dipleg extending from the separator and a horizontal leg connecting the outlet of the vertical leg to the furnace section. U.S. Pat. No. 4,709,662 discloses an L-valve connecting the outlet of an external heat exchanger to the inlet of a furnace. This L-valve has a vertical leg in which solid material accumulates to form a head of material providing a pressure seal. Although the L-valve enjoys the advantage of being drainable, i.e. solids can be removed from the valve during shutdown or the like, it is also not without problems. For example, the seal height is not directly equal to the pressure difference across the valve and the valve is very sensitive to back pressure surges from the furnace. Also, additional fans are usually required to maintain a minimum fluidizing air pressure in the L-valve.

SUMMARY OF THE INVENTION

It is therefore an object of the present invention to provide a fluidized bed combustion system and method which has an improved pressure seal between the furnace and the separator.

It is a further object of the present invention to provide a fluidized bed combustion system and method of the above type in which the pressure seal is achieved by a valve that is drainable.

It is a still further object of the present invention to provide a system and method of the above type in which the valve operates at a relatively low fluidizing air pressure and requires no additional fans.

It is a still further object of the present invention to provide a system and method of the above type in which the valve is relatively insensitive to back pressure surges from the furnace.

It is a still further object of the present invention to provide a pressure seal valve of the above type.

Toward the fulfillment of these and other objects, a fluidized bed combustion system is provided in which a separator receives a mixture of flue gases and entrained particulate material from the fluidized bed in the furnace and separates the particulate material from the flue gases. A pressure seal valve connects the outlet of the separator to the furnace for passing the separated material from the separator to the furnace. The valve is drainable, its seal height is directly proportional to the pressure drop across the system, and it absorbs back pressure surges from the furnace.

BRIEF DESCRIPTION OF THE DRAWINGS

The above brief description, as well as further objects, features and advantages of the present invention will be more fully appreciated by reference to the following detailed description of the presently preferred but nonetheless illustrative embodiments in accordance with the present invention when taken in conjunction with the accompanying drawing wherein.

DESCRIPTION OF THE PREFERRED EMBODIMENT

Figure 2:
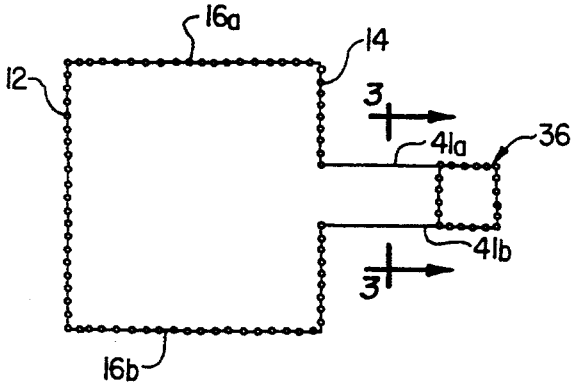
FIG. 2 is a cross-sectional view taken along the line 2—2 of FIG. 1.

The drawings depicts the fluidized bed combustion system of the present invention used for the generation of steam. The system includes an upright water-cooled furnace, referred to in general by the reference numeral 10, having a front wall 12, a rear wall 14 and two sidewalls 16*a* and 16*b* (FIG. 2). The upper portion of the furnace 10 is enclosed by a roof 18 and the lower portion includes a floor 20.

A perforated plate, or grate, 22 extends across the lower portion of the furnace 10 and extends parallel to the floor 20 to define an air plenum 24. The plenum 24 receives air from a duct 26 which, in turn, is connected to a source of air (not shown). A plurality of vertical nozzles 28 extend upwardly from the plate 22 and register with the perforation in the plate for distributing air from the plenum 24 into the furnace section 10.

It is understood that a feeder system (not shown) is provided adjacent the front wall 12 for introducing particulate fuel material into the furnace 10. Adsorbent, such as limestone, in particle form can also be introduced into the furnace 10 in a similar manner. The particulate fuel and adsorbent material are fluidized by the air from the plenum 24 as it passes upwardly through the plate 22. This air promotes the combustion of the fuel which generates combustion gases, and the resulting mixture of the combustion gases and the air (hereinafter collectively termed "flue gases") rises in the furnace 10 by convection and entrains a portion of the particulate material as will be described.

A cyclone separator 30 is located adjacent the furnace 10 and a duct 32 extends from an outlet opening 14*a* provided in the rear wall 14 of the furnace 10 to an inlet opening 30*a* provided through the wall of the separator 30. The separator 30 thus receives the flue gases and the entrained particle material from the furnace 10 and operates in a conventional manner to disengage the particulate material from the flue gases due to the centrifugal forces created in the separators.

The separated flue gases in the separator 30, which are substantially free of solids, pass from the separator through a vertical duct 34 having a portion extending in the separator for receiving the separated flue gases, and a portion projecting from the separator for passing the flue gases to a heat recovery section (not shown) for further treatment.

Figure 1:
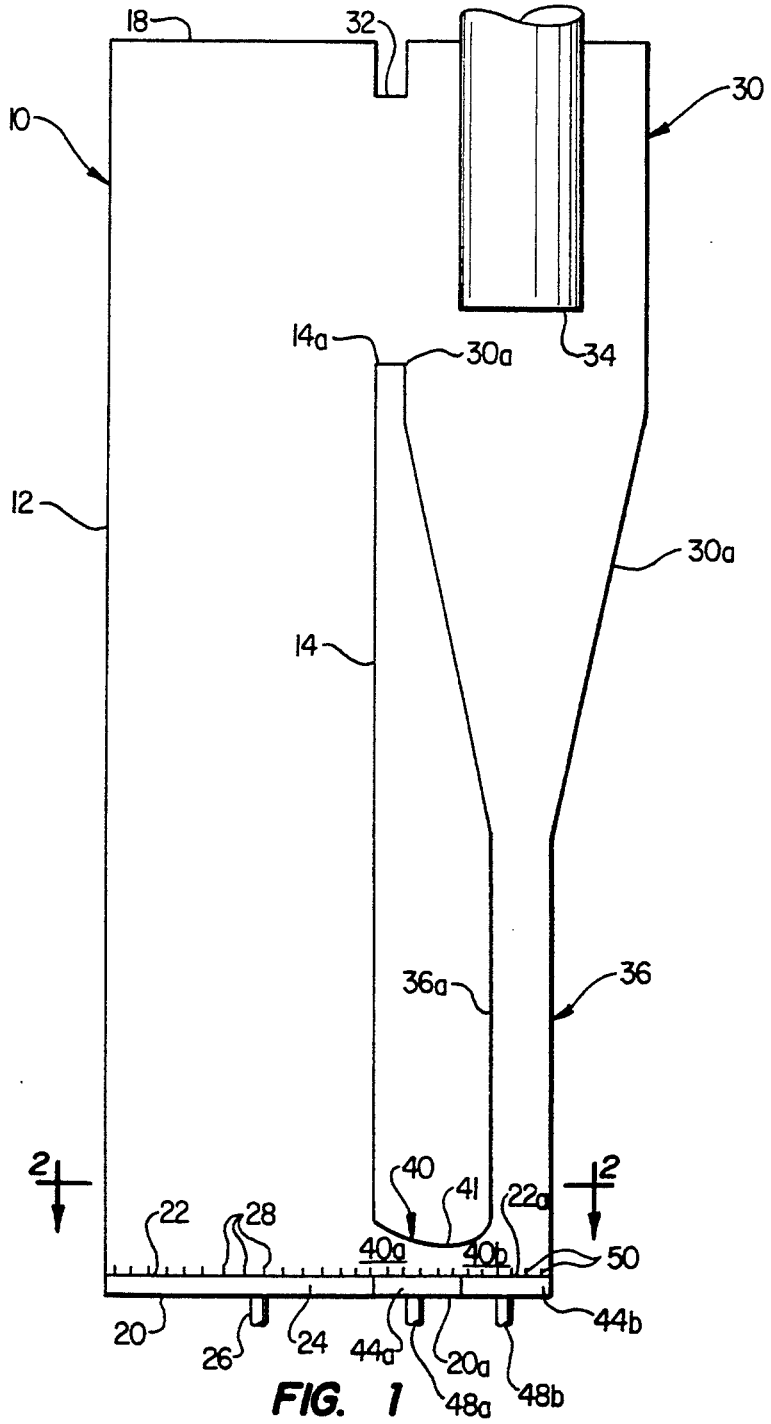
FIG. 1 is a schematic representation depicting the system of the present invention.

A hopper section 30*a* extends from the lower portion of the separator and is connected to a dipleg 36 which extends downwardly to the level of the floor 20 of the furnace section 10. As shown in FIGS. 1 and 2, a duct 40 connects the lower end portion of the dipleg 36 to an opening 14*b* in the lower portion of the rear wall 14. The duct 40 is formed by an extension 22*a* of the plate 22, by a plate 41 connecting the furnace rear wall 14 to the front wall 36*a* of the dipleg 36, and by two side walls 41*a* and 41*b* (FIG. 2). The duct 40 thus transfers the separated solids from the dipleg 36 to the furnace 10 and also functions to prevent backflow of solids from the furnace to the dipleg 28 in a manner to be described.

A floor 42 extends below, and parallel to, the extension 22*a* of the plate 22 to form a plenum which is divided into two sections 44*a* and 44*b* by a vertical partition 46. The plenum sections 44*a* and 44*b* receive air from two ducts 48 and 48*b*, respectively, which, in turn, are connected to the above-mentioned air source. A plurality of vertical nozzles 50 extend upwardly from the plate extension 22*a* and register with the perforations in the latter plate for introducing air from the plenum sections 44*a* and 44*b* into the duct 40.

Figure 4:
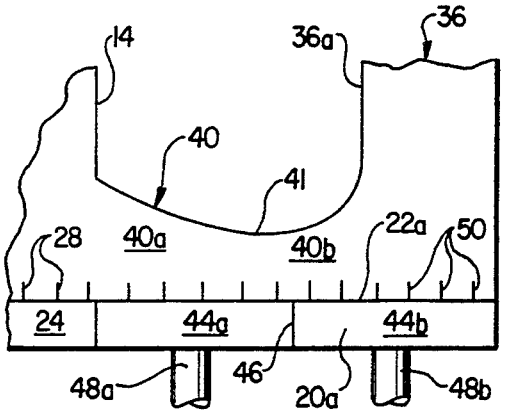
FIG. 4 is an enlarged view of a portion of the system of FIG. 1.

As better shown in FIG. 4, the plate 41 curves downwardly from the front wall 36*a* of the dipleg 36 towards the wall 14*a* and then upwardly to the latter wall which forms a necked-down portion that divides the duct 40 into two sections 40*a* and 40*b*. Due to the upwardly curved portion of the plate 41, the cross-sectional area of the duct 40 increases in a direction towards the furnace 10, for reasons to be described.

Figure 3:
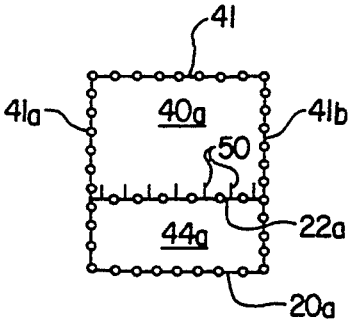
FIG. 3 is an enlarged cross-sectional view taken along the line 3-2 of FIG. 2.

As shown in FIGS. 2 and 3, the front wall 12, the rear wall 14, the sidewalls 16*a* and 16*b*, as well as the walls defining the dipleg 36 (and the separator 30) and the duct 40 all are formed by a plurality of spaced tubes having continuous fins extending from diametrically opposed portions thereof to form a gas-tight membrane in a conventional manner. (The diameter of the tubes are exaggerated in FIGS. 2 and 3 for the convenience of presentation.)

It is understood that a drain pipe, or the like, may be associated with the plate 22 as needed for discharging the particulate material from the furnace 10. Also, a steam drum (not shown) may be provided along with a plurality of headers disposed at the ends of the various water-tube walls described above which, along with downcomers, water pipes, etc., establish a steam and water flow circuit including the aforementioned water tube walls. Thus, water is passed, in a predetermined sequence through this flow circuitry, to convert the water to steam and heat the steam by the heat generated by combustion of the particulate fuel material in the furnace 10.

In operation, particulate fuel material and particulate sorbent material are introduced into the furnace 10. Air from an external source is introduced at a sufficient pressure into the plenum 24 so that the air passes through the nozzles 28 at a sufficient quantity and velocity to fluidize the particles in the furnace 10.

A lightoff burner (not shown), or the like, is provided to ignite the fuel material, and thereafter the fuel material is self-combusted by the heat in the furnace 10. A homogeneous mixture of the fuel particles and the adsorbent particles, in various stages of combustion and reaction, is thus formed in the furnace 10, which mixture is hereinafter referred to as the "particulate material".

The flue gases pass upwardly through the furnace 10 and entrain, or elutriate, a portion of the particulate material. The quantity of particulate material introduced into the furnace 10 and the quantity of air introduced into the interior of the furnace is established in accordance with the size of the particulate material so that a dense bed is formed in the lower portion of the furnace 10 and a circulating fluidized bed is formed in the upper portion thereof, i.e. the particulate material is fluidized to an extent that substantial entrainment or elutriation thereof is achieved. Thus the density of the particulate material is relatively high in the lower portion of the furnace 10, decreases with height throughout the length of the furnace and is substantially constant and relatively low in the upper portion of the furnace. This technique is more specifically disclosed in U.S. Pat. No. 4,809,623 and No. 4,809,625, both assigned to the assignee of the present invention, the disclosures of which are incorporated by reference.

The flue gases passing into the upper portion of the furnace 10 are substantially saturated with the particulate material and pass, via the outlet opening 14*a* in the upper portion of the rear wall 14 and the duct 32, into the inlet opening 30*a* of the cyclone separator 30.

In the separator 30, the particulate material is separated from the flue gases and the latter pass from the separator 30, via the duct 34, to a heat recovery area, or the like. The separated particulate material from the separator 30 passes downwardly through the hopper section 30*a* and into the dipleg 36 where it builds up in the lower portion of the dipleg and passes into the duct 40. Fluidizing air is introduced, via the ducts 48*a* and 48*b*, into the plenum sections 44*a* and 44*b*, respectively, and to the nozzles 50 in the duct 40 to fluidize the particulate material therein. The velocity of the air introduced into the plenum section 44*a* is greater than that introduced into the section 44*b* so that a relatively dilute fluidized bed is formed in the duct section 40*a* and a relatively dense fluidized bed is formed in the duct section 40*b*, with the necked-down portion of the duct 40 serving as a baffle between the two beds. Moreover, the velocities of the air discharging from the nozzles 28 in the duct portion 40*a* are regulated so that the velocities progressively increase in a direction from the relatively dense bed in the duct portion 40*b* to the furnace 10.

A pressure head is formed by the level of particulate material building up in the dipleg 36 and a pressure seal is established sufficient to prevent backflow of the particulate material from the furnace 10, through the duct 40 and to the separator 30. The design is such that the height of the particulate material corresponds to, and varies with, the pressure drop from the furnace to the separator.

The relatively dilute bed in the duct section 40*a* downstream from the pressure seal absorbs pressure pulses from the furnace 10 and compensates for frictional losses to promote the flow of the particulate material from the dipleg 36 to the furnace 10; while the relatively dense led in the duct section 40*b* dampens the pressure fluctuations. The portion of the duct 40 that increases in cross-sectional area in a direction towards the furnace 10 accommodates a more expanded solids/-gas mixture, and the heights of the beds in the duct sections 40*a* and 40*b* are substantially equal to the height of the dense bed in the furnace 10.

Feedwater is introduced to and circulated through the flow circuit described above in a predetermined sequence to convert the feed water to steam and to reheat and superheat the steam.

Figure 5:
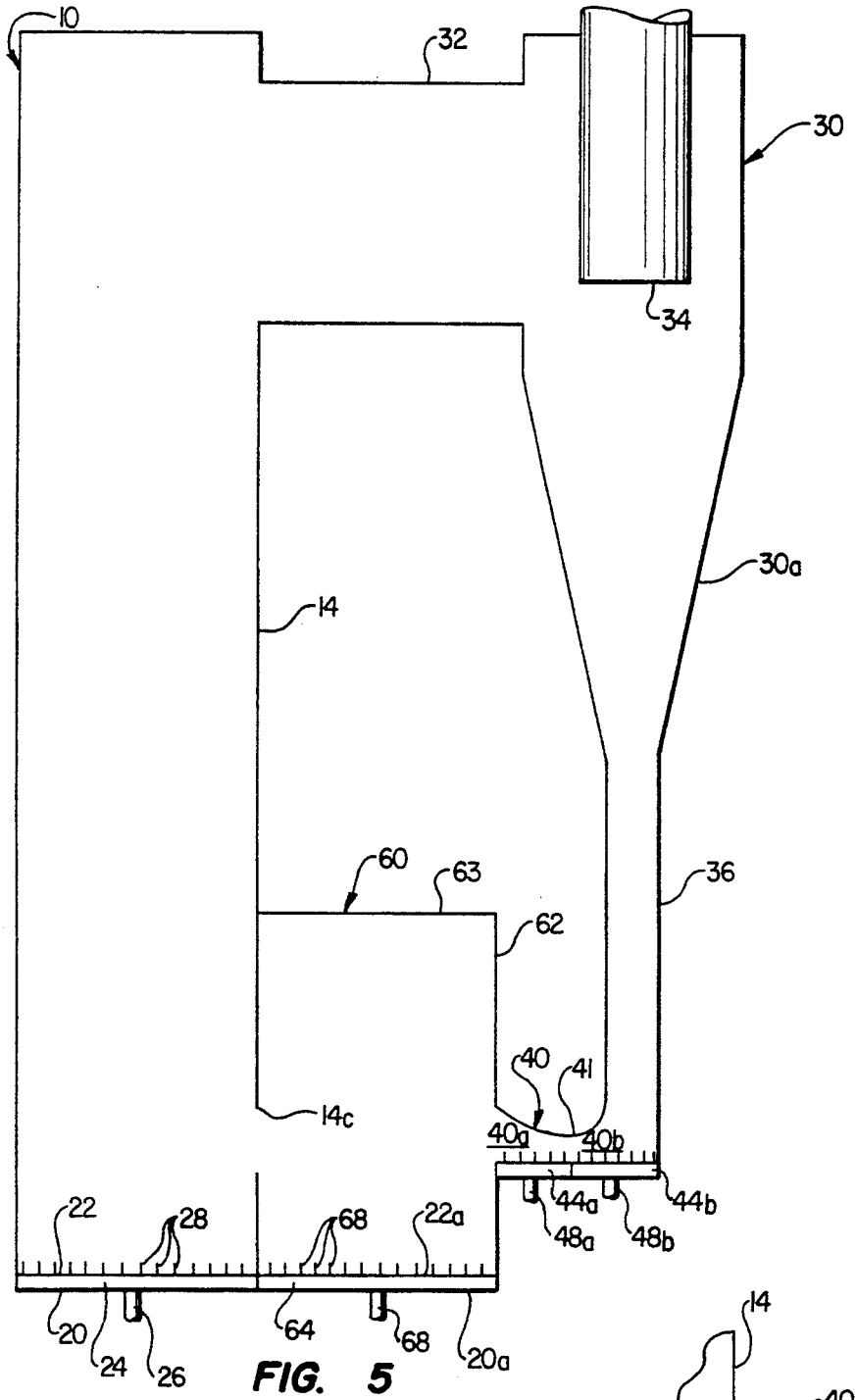
FIG. 5 is a view similar to FIG. 1 but depicting an alternate embodiment of the system of the present invention.

The embodiment of FIG. 5 contains components identical to some of the components of the embodiment of FIGS. 1–4 which components are given the same reference numerals and will not be described further. According to the embodiment of FIG. 5 an external heat exchanger, shown in general by the reference numeral 60, extends between the furnace 10 and the duct 40. The lower portion of the rear wall 14 of the furnace 10 forms the front wall of the heat exchanger 60 and a wall 62 is disposed in a spaced relationship to the latter rear wall portion to form the rear wall of the heat exchanger 60. A horizontal roof 63 connects the walls 14 and 62, and an extension 20*a* of the floor 20 of the furnace 10 forms the floor of the heat exchanger 60. The plate 22 of the furnace 10 is also extended, as shown by the reference numeral 22*a*, to form a plenum 64 between the floor extension 20*a* and the plate extension 22*a*. The plenum 64 receives air from a duct 66 which, in turn, is connected to an external source of air (not shown) which can be the same source that supplies the plenum 24 and the plenum section 44*a* and 44*b*.

A plurality of vertical nozzles 68 extend upwardly from the plate extension 22*a* and register with the perforations in the plate for distributing air from the plenum 64 into the heat exchanger 60. (It is noted that the plenum sections 44*a* and 44*b* extending below the duct 40 are located at a higher level than the plenum section 24 and 64 and are formed by a separate plate section and floor section rather than by extensions of the floor 20 and the plate 22 as in the previous embodiment.)

An opening 62*a* is formed in the rear wall 62 of the heat exchanger 60 approximately midway between its ends and registers with the outlet end of the duct 40. An opening 14*c* is formed in the lower portion of the rear wall 14 which connects the interior of the heat exchanger 60 with that of the furnace 40.

It is understood that one or more banks of heat exchange tubes, or the like, (not shown) can be provided in the heat exchanger 60 and connected in the above-identified flow circuit for passing cooling fluid in a heat exchange relation to the separated particulate material introduced therein. Further details of the heat exchanger 60 are disclosed in U.S. Pat. No. 5,069,170, No. 5,069,171 and No. 5,140,950, all assigned to the assignee of the present invention, the disclosures of which are incorporated by reference.

The operation of the embodiment of FIG. 5 is similar to that of FIGS. 1–4 with the exception that the separated particulate material from the dipleg 36 flows through the duct 40 in the manner described above and then through the opening 62*a* in the wall 62 into the interior of the heat exchanger 60. The particulate material is cooled in the heat exchanger 60 while it is fluidized by air introduced into the interior of the heat exchanger 60 by the nozzles 68 as disclosed in the last three cited patents. The cooled particulate material then flows through the opening 14*c* back into the furnace 10. The location of the openings 14*c* and 62*a* are such that the height of the dense particulate material in the furnace section 10 is substantially equal to the height of the material in the heat exchanger 60 and in the duct 40. Otherwise the operation of the embodiment of FIG. 5 is identical to that of FIGS. 1–4.

The systems of both embodiments the present invention have several advantages. For example, the duct 40 and the dipleg 36 create a non-mechanical pressure seal valve which prevents the backflow of particulate material from the furnace to the separator. Also, the necked-down portion of the duct 40 enables a relatively dense and a relatively dilute bed to be formed in the duct to enable the pressure seal to be established, yet permits the flow of particulate material from the dipleg to the furnace 10. The increase in the velocity of air introduced into the relatively dilute bed in the duct portion 40*a*, along with the increased cross sectional area of the latter duct portion in the direction towards the furnace 10 promotes the flow of the particulate sectional to the furnace 10. Also, the duct 40 is drainable and the valve created is not sensitive to back pressure surges from the furnace. Further, no additional fans are required to create the fluidizing velocities in the duct sections 40*a* and 40*b*.

Other modifications, changes and substitutions are intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. A fluidized bed combustion system comprising:

a furnace;

means for establishing a fluidized bed of combustible particulate material in said furnace;

separating means for receiving a mixture of flue gases and entrained particulate material from said fluidized bed in said furnace and separating said particulate material from said flue gases;

first duct means extending from said separating means for receiving said separated particulate material;

second duct means connecting said first duct means to said furnace, at least a portion of said second duct means increasing in cross-sectional area in a direction towards said furnace to promote the flow of said particulate material from said second duct means to said first duct means and to allow said particulate material to build up in said first duct means for establishing a pressure seal for preventing the backflow of said separated particulate material from said furnace to said separating means; and means for establishing a relative dense fluidized bed and a relatively dilute fluidized bed in said second duct means for dampening pressure fluctuation from said furnace and promoting said flow of fluid particulate material through said second duct means.

2. The system of claim 1 wherein said first duct means comprises a substantially vertical duct and said second duct means comprises a substantially horizontal duct.

3. The system of claim 1 or 2 wherein said means for establishing said relatively dense fluidized bed and said relatively dilute fluidized bed in said second duct means comprises means for introducing air into two portions of said second duct means.

4. The system of claim 3 wherein said air introducing means introduces air in two portions of said second duct means at two different velocities, respectively.

5. The system of claim 4 wherein said relative dense fluidized bed is located adjacent said separating means and dampens pressure fluctuation from said furnace.

6. The system of claim 4 wherein said relatively dilute fluidized bed is located adjacent said furnace and promotes said flow of particulate material to said furnace.

7. The system of claim 6 wherein said air introducing means introduces air into said dilute fluidized bed at velocities that increase in a direction towards said furnace so that said dilute bed in said other portion becomes more dilute in said direction to promote said flow.

8. The system of claim 3 wherein said air fluidizes said separated particulate material in said two portions of said second duct means.

9. The system of claim 1 further comprising heat exchange means extending between said second duct means and said furnace for receiving said separated particulate material from said second duct means, removing heat from said separated particulate material and passing said separated particulate material to said furnace.

10. A method of combustion comprising the steps of:

establishing a fluidized bed of combustible particulate material in a furnace;

combusting said particulate material in said furnace to form a mixture of flue gases and entrained particulate material;

passing said mixture from said furnace;

separating said particulate material from said flue gases;

passing said separated particulate material into a first duct;

passing said separated particulate material from said first duct to a second duct;

passing said separated particulate material from said second duct to said furnace, said first duct establishing a first pressure seal for preventing the backflow of said separated particulate material from said furnace and at least a portion of said second duct having an increasing cross-sectional area in a direction towards said furnace to promote said flow; and establishing a relatively dense fluidized bed and a relatively dilute fluidized bed in said second duct for dampening pressure fluctuation from said furnace and promoting the flow of said separated particulate material through said second duct.

11. The method of claim 10 wherein said first duct extends substantially vertically and wherein said second duct extends substantially horizontally.

12. The method of claim 10 or 11 wherein said step of establishing a relatively dense fluidized bed and a relatively dilute fluidized bed in said second duct comprise the step of introducing air in two portions of said second duct.

13. The method of claim 12 wherein said air is introduced in two portions of said second duct at two different velocities.

14. The method of claim 14 wherein said air introducing means introduces air into said dilute fluidized bed at velocities that increase in a direction towards said furnace so that said dilute bed becomes more dilute in said direction to promote said flow.

15. The method of claim 12 wherein said air fluidizes said separated particulate material in said duct.

16. The system of claim 10 further comprising the step of removing heat from said separated particulate material before said step of passing said separated particulate material to said furnace.

17. A fluidized bed combustion system comprising:

a furnace;

means for establishing a fluidized bed of combustible particulate material in said furnace;

separating means for receiving a mixture of flue gases and entrained particulate material from said fluidized bed in said furnace and separating said particulate material from said flue gases;

first duct means extending from said separating means for receiving said separated particulate material; and second duct means connecting said first duct means to said furnace, at least a portion of said second duct means increasing in cross-sectional area in a direction towards said furnace to promote the flow of said particulate material from said second duct means to said first duct means and to allow said particulate material to build up in said first duct means for establishing a pressure seal for preventing the backflow of said separated particulate material from said furnace to said separating means.

* * * * *